US009919179B2

(12) United States Patent
Nevarez, Jr.

(10) Patent No.: US 9,919,179 B2
(45) Date of Patent: Mar. 20, 2018

(54) EXERCISE DEVICE

(71) Applicant: Jesus Nevarez, Jr., Oceanside, CA (US)

(72) Inventor: Jesus Nevarez, Jr., Oceanside, CA (US)

( * ) Notice: Subject to any disclaimer, the term of this patent is extended or adjusted under 35 U.S.C. 154(b) by 0 days.

(21) Appl. No.: 15/025,210

(22) PCT Filed: Mar. 25, 2016

(86) PCT No.: PCT/US2016/024284
§ 371 (c)(1),
(2) Date: Mar. 25, 2016

(87) PCT Pub. No.: WO2016/154565
PCT Pub. Date: Sep. 29, 2016

(65) Prior Publication Data

US 2018/0001131 A1 Jan. 4, 2018

Related U.S. Application Data

(60) Provisional application No. 62/138,211, filed on Mar. 25, 2015.

(51) Int. Cl.

| | |
|---|---|
| ***A63B 21/06*** | (2006.01) |
| ***A63B 21/062*** | (2006.01) |
| ***A63B 21/00*** | (2006.01) |
| ***A63B 23/02*** | (2006.01) |
| ***A63B 23/04*** | (2006.01) |
| ***A63B 21/055*** | (2006.01) |
| *A63B 21/068* | (2006.01) |
| *A63B 21/008* | (2006.01) |

(52) U.S. Cl.
CPC ..... *A63B 21/0628* (2015.10); *A63B 21/0552* (2013.01); *A63B 21/155* (2013.01); *A63B 21/4033* (2015.10); *A63B 21/4047* (2015.10); *A63B 23/0205* (2013.01); *A63B 23/0482* (2013.01); *A63B 21/008* (2013.01); *A63B 21/068* (2013.01)

(58) Field of Classification Search
None
See application file for complete search history.

(56) References Cited

U.S. PATENT DOCUMENTS

| | | | | |
|---|---|---|---|---|
| 3,235,255 A * | 2/1966 | Leflar | ..... | A63B 21/0724 482/104 |
| 5,411,458 A * | 5/1995 | Giust | ..... | A63B 21/068 482/101 |
| 6,015,372 A * | 1/2000 | Steffee | ..... | A63B 21/155 452/100 |
| 6,475,123 B1 * | 11/2002 | Evans | ..... | A63B 23/02 428/130 |

(Continued)

*Primary Examiner* — Stephen R Crow

(57) ABSTRACT

An exercise machine is provided which is configured to place a user in an exercise position, wherein movement during exercise against a load will target the gluteus maximus muscles. The exercise machine positions the body of a user in a lowered or exercise position which supports the user while raising their body to an elevated position, in a manner to stabilize the user and direct movement of the user along the sagittal plane during use, while concurrently isolating the gluteus maximus muscles as the muscles overcoming the load.

20 Claims, 4 Drawing Sheets

(56) References Cited

U.S. PATENT DOCUMENTS

| | | | | |
|---|---|---|---|---|
| 6,743,158 | B2 * | 6/2004 | Giannelli | A63B 21/068 482/101 |
| 6,776,743 | B2 * | 8/2004 | Hur | A63B 23/02 482/140 |
| 7,115,081 | B2 * | 10/2006 | Stearns | A63B 21/055 482/140 |
| 8,602,953 | B2 * | 12/2013 | Jordan | A63B 21/055 482/121 |

* cited by examiner

EXERCISE DEVICE

This application claims the benefit of U.S. Provisional Patent Application Ser. No. 62/138,211 filed on Mar. 25, 2015, which is incorporated herein in its entirety by this reference thereto.

FIELD OF THE INVENTION

The disclosed device and method herein relate generally to resistive exercise devices and methods of employment thereof. More particularly, it relates to an exercise device configured to position the user in an exercise position adapted to communicate the load from engaged resistance components such as weights or hydraulic or pneumatic cylinders, primarily to the gluteus maximus muscles during contraction of those muscles concentrically along a sagittal plane of motion, during a hip extension, and subsequently eccentrically returning to hip flexion.

BACKGROUND OF THE INVENTION

Resistance exercise has become more popular in countries throughout the world as a means to exercise the body to generally enhance health. Workouts on such exercise equipment provide an excellent means to maintain fitness of muscles, bones and the circulatory system, while concurrently providing a means for burning calories to aid in weight control and reduction. Because of the ease of use exercise machines targeted to muscle groups provide to users, as opposed to free weights, such exercise machines have become ever more popular in recent decades.

Such resistive exercise machines have developed over time in a manner where the machines have been specially designed and constructed to target exercise to specific muscles and muscle groups during repetitive use of a specialized machine. Consequently, users of such devices are able to pick and use resistance exercise machines which are specially designed to target the exercise to specialized muscles and muscle groups which each user chooses.

It is widely thought that most individuals will benefit from improving the strength and flexibility of the body structures of the hip and pelvic region. The human pelvis communicates force and energy of body movements between the lower body to the upper body. It is well known that when there is a proper muscular and physical relationship between the pelvis and the hip joints, such may tend to reduce the chance of injury during exercise and more importantly, during daily living activities such as bending and lifting objects.

One preferred method for maintaining such a balanced and proper relationship between the pelvis and hip joints, and the muscles of the body connected therewith, is exercising the muscles of the pelvis/hip complex, in sequential movements or repetitions against a resistive force. The pelvis and hip muscle complex includes the gluteal muscles including the gluteus minimus, the gluteus medius and the gluteus maximus muscles which have been shown to be critical in maintaining strength and muscle balance of the hip and lower back region of the body. Exercising this region also has been shown to maintain or increase bone strength as well as the strength of connective ligaments.

The pelvis and hip muscle complex also plays a critical role in the position of the sacrum, which in turn drives the position of the pelvis, which in turn drives the position of the remainder of both the lower and upper spine. During exercise and during normal daily activities during any given day, stress and strain during body movements are communicated to these muscle groups. Such can occur during movements such as during walking, running, cycling, jumping, skipping, swimming, lifting, or other normal daily movements. It is thus important to avoid injury, strain, and the resulting pain, and to maintain bone mass and connective tissue strength, that the gluteal muscles noted, are exercised frequently and properly.

However, most people, including those visiting fitness centers, fail to properly exercise the gluteal muscles properly or in a frequency which will provide the benefits that such exercise as noted above, imparts. Such a failure to exercise this muscle group is not entirely the fault of most people.

A primary reason for this lack of effective and frequent exercise of this important muscle group, is the lack of equipment configured to position the body to directly exercise the gluteus maximus muscles and the bones and joints and ligaments connecting them, in an exercise properly directed along the sagittal plane. Conventionally, available exercise machines adapted for resistance exercise for the gluteus maximus muscles, are either intended for other purposes and very hard to use, or require unsupported positioning of the user during use which fails to direct the load of the resistance to the gluteus maximus muscles properly. Such machines fail to focus the resistance load, during exercise, directly to the gluteus maximus during movement along the sagittal plane, and position the body of the user in positions where leg and other muscle groups are involved in an unfocused manner.

Further, such conventionally available exercise machines fail to provide structure to position the body of the user in an exercise position, configured to direct motion during their exercise, primarily along the sagittal plane. Thus, users are not able to comfortably isolate and thereby target and communicate the resistance load, during exercise, to the gluteus maximus muscles, with safety and precision. Consequently, users are left with uncomfortable, sometimes even painful modes and machinery with which to attempt proper exercise of the gluteus maximus muscles. Further, these available exercise machines are inefficient and require excessive repetitions and use due to the lack of a configuration which targets the resistance load during use, to exercise the gluteus maximus muscles.

As such their exists an unmet need, for an exercise device and method which is easily employed and comfortable during use. Such an exercise device should position the user comfortably and properly such that during use, the exercise movement runs substantially along the sagittal plane, and should not require a spotter. Such an exercise device should provide means to communicate a resistive force or load during exercise, in a highly targeted fashion in an isolated and directed manner, directly to the gluteus maximus muscles, thereby making it more efficient for users.

The forgoing examples of related art and limitations related therewith are intended to be illustrative and not exclusive, and they do not imply any limitations on the exercise device and method described and claimed herein. Various limitations of the related art are already known or will become apparent to those skilled in the art upon a reading and understanding of the specification below and the accompanying drawings.

SUMMARY OF THE INVENTION

In accordance with the objects of the present invention, as embodied and broadly described herein, the present device and method provides users a comfortable, safe, and efficient means to exercise the gluteus maximus muscles. The device does so through the provision of an exercise machine configured to position the user in an exercise position wherein movement during use is directed primarily along the sagittal plane, and thereby targets an engaged resistive force or load, in a focused and isolated manner, to efficiently exercise the gluteus maximus muscles. The device itself may be configured for engagement to a load from a resistive force, such as weight stacks, hydraulic or pneumatic or elastic modes of such, or can be configured to include such in a single machine.

Such a load may be from a resistive force generated by one or a combination of load generators from a group including a weight stack, a free weight, elastic members, springs, hydraulic resistance components and pneumatic resistance components, which are operatively connected to the exercise machine herein using for example a flexible member such as a cable. A first end of the cable is operatively engaged to the exercise device to communicate a load to the user at a precise point during movement, and a second end thereof is operatively adapted for engagement with a load generated by a resistive component.

While shown engaged with a weight stack in some modes herein for convenience, such is not meant to be limiting as to a means for resistance or a load in any fashion and it is anticipated the device herein may be engaged with any adjustable resistive force load generating component which will communicate to the exercise device herein, a range of resistance to user movement required for use.

So adapted for engagement with a load from a resistive force, the device herein features a frame adapted for operative positioning on a floor or other support surface. The frame includes upright members and diagonal supports to allow for support of a translatable base upon a diagonal angled track.

At a first end of the frame, a horizontally disposed foot platform is positioned and has an upper surface which is generally planar to provide a support for the feet of a user during use of the device. A support member with a cushion adjacent one end of the foot platform is vertically disposed relative to the planar foot support. The cushion faces the foot support and is operatively engaged with a support rising from the frame immediately adjacent the foot platform.

This adjacent perpendicular positioning of foot support and cushion provides support of the knees of the user against the cushion during use of the device with their feet concurrently upon the foot support. This novel foot and knee positioning during use, along with the back support on an opposing side of the body of the user, significantly improves targeting of the resistive force of the machine directly and efficiently to the gluteus maximus muscles, by positioning a pivot defined at the hips of the user, as the primary means for raising a padded support contacting the abdomen of the user. Due to this positioning of the user in an exercise position with planted feet and back, the motion of the user during exercise is directed along the sagittal plane which runs through the middle of the body of the user.

To adjust a position of contact of a pivoting arm with the body of the user, as well as contact with the back of the user when in an elevated position, a translatable base or body is provided which is slidably engaged with one or a plurality of tracks. The base thus is on an incline from a lower end adjacent the foot support and first end of the frame, toward a higher or elevated end, engaged to a riser adjacent the second end of the frame. A currently preferred mode of the device, positions the diagonal track at an angle between 5 and 20 degrees with 10 degrees being particularly preferred as an angle employable for use with most users. This angle could be rendered adjustable if such is required.

The base or body for support of the back of the user during use in moving to an elevated position, is adjustably slidable by users to position it along the inclining track to an adjusted position. This adjusted position adapts the device to the body of the user, to properly position the body of the user relative to a pivoting arm used to target communication of the load from resistance to movement of the arm, directly to the gluteus maximus muscles according to the height and build of the user.

The base may be in a ratcheted engagement with the track which will allow for translation upward for adjustment once a clamp or lock is released, but will prevent it from sliding downward. The ratchet may be subsequently released using a release handle for users wishing to move the base downward toward the foot rest.

A dense foam or similar padding material may be formed to a cushion engaged to the base. This cushion is mounted on an upper surface of the sliding base to provide support against the back of the torso of the user during use of the device.

Additionally in rotating engagement with the base, is a pivoting arm which may have an adjustable point of engagement of the pivot point on the pivoting arm, with the machine. Such allows for an adjustable range of motion for the user and thereby allows the user to increase or decrease work distance during use.

The pivoting arm is also in operative engagement with a load from a resistive force. Such can be free weights connected to the pivoting arm, or a cable or flexible member engaged at a first end thereof using a cam or other means for engagement. In this cable mode, the opposite end of the cable or flexible member is operatively engaged with a fixed or preferably a variable load generated by a resistance device, such as a weight stack, pneumatic cylinder, hydraulic cylinder, elastic band, or other means for biased resistance to translation of the cable which is activated by rotation of the pivoting arm during use of the device.

In a preferred mode of the device, a contact point with the user during use, whereby the user may impart force through upward hip movement, along the sagittal plane, while moving to an elevated position to rotate the pivoting arm, is provided by a secondary arm which is engaged with the pivoting arm. This secondary arm may be telescopic in length or be provided in a plurality of sizes or adjustable sizes in length, to allow for positioning of the user back support to help position the body mid section against an optimal point on the lower abdominal area of the body of the user.

With the user in an as-used, or exercise position, with their legs and feet urged to a proper position through foot placement on the foot platform, and their knees adjacent or contacting the vertical cushion, and their buttocks or lower back supported across from the vertical cushion, the positioning of the contact point with the user may be adjusted by sliding the base upon the track and adjusting the position of one or both of the length of the adjustable secondary arm and adjusting the pivot point on the pivoting arm. Of course once the base is properly and comfortably adjusted for positioning against the user's back, adjustment of the contact point against the front of the user's body, to the desired position may be accomplished by adjusting one or both of the pivot points of the pivoting arm, and the length of the secondary arm.

As noted, the device is shown herein with a weight stack providing the load from a resistive force for convenience.

Engagement of the pivoting arm to the weight stack or other employed resistive force, is accomplished by cable or other flexible member engaged over, for instance, the depicted 4-pulley cable system. However, any resistance to movement can be employed such as free weights or pneumatic or hydraulic resistance.

As shown herein, in all modes of the device, the configuration of user body-positioning components places the user in the exercise position, which requires movement along the sagittal plane to move the bar, and maximizes the result in a comfortable and safe exercise. By positioning themselves in the device in an as-used or exercise position, the user is provided with a back support on a base and leg support from a foot platform which places their feet adjacent a vertical support which may have a cushion. This proximate positioning adjacent the vertical support automatically places the knees of the user proximate to or contacting the vertical support. Such a contact supporting both the feet and knees in stationary positions, with a back support adapted to hold the user's back at a position opposing the potential contact point of the knees, positions the user during movement to the elevated position, such that their hip joints form a pivot in between the supported back and knees.

Thus, the foot platform and vertical support in combination with the back support, automatically provides the proper support and positioning to the user during movement to the elevated position from the exercise position, to cause the user to move along the sagittal plane, and maximize the results by isolating the gluteus maximus muscles for moving the load during use, since this muscle group is employed to pivot the hips to raise the padded bar when the user moves from an exercise position to the elevated position.

While with some users the vertical support is not always necessary, it was found in experimentation without this foot platform placement and vertical support stabilizing the feet and lower leg of the user, and the opposing positioning of the back support, the user may tend to translate laterally during movement to the elevated position. Thus, the workout may be much less focused and much less efficient should their body slide or translate sideways toward the first end.

Consequently, the lower leg positioning and vertical support herein, and the opposing back support along an imaginary line running from the knee contact with the vertical cushion, during movement to or reaching an elevated position, prevents lateral translation of the body of the user during use. This movement from the exercise position with the upper legs angled downward along with the torso, centers the hip joints of the user in-between the knee support and back support, and is key in placing the user in the exercise position which requires the user to employ the gluteus maximus muscles during exercise, and preferred in all modes of the device.

During use with the user in the as-used or exercise position, they will employ the device to move the pivoting arm in contact with their abdomen in a movement along the sagittal plane, from an exercise position where they are lowered or almost sitting, and where the axis of their spine and torso is substantially perpendicular or normal to the axis of their upper leg or femur. By moving from the exercise position to the elevated position toward a substantial alignment of the axis of their back is substantially aligned with the axis of their femur, the user must employ the gluteus maximus muscles to raise their body. From this elevated position, they will return to the lowered or exercise position, again using the isolated gluteus maximus muscles. They may repeat the exercise for a number of repetitions as needed. The two different movements toward differing axis alignments are achieved easily with the feet and lower legs supported by the lower leg positioning component herein.

So employed, the device allows significant movement of the hips of the user into both a hip extension (in a forward direction toward the raised position), and back into hip flexion (in a rearward direction toward the lowered position), which is focused along the sagittal plane. This movement is designed to actuate the gluteus maximus muscles of the user in an isolated fashion, contracting them concentrically during hip extension and then eccentrically returning to hip flexion. This focused exercise significantly enhances the amount of work the user can impart to their gluteus maximus muscles, moving against the load, over that of conventional exercise devices.

With respect to the above description, before explaining at least one preferred embodiment of the herein disclosed exercise machine invention in detail, it is to be understood that the invention is not limited in its application to the details of construction and to the arrangement of the components in the following description or illustrated in the drawings. The exercise device herein described and disclosed in the various modes and combinations is also capable of other embodiments and of being practiced and carried out in various ways which will be obvious to those skilled in the art. Any such alternative configuration as would occur to those skilled in the art is considered within the scope of this patent. Also, it is to be understood that the phraseology and terminology employed herein are for the purpose of description and should not be regarded as limiting.

As such, those skilled in the art will appreciate that the conception upon which this disclosure is based may readily be utilized as a basis for designing of other exercise devices for carrying out the several purposes of the present disclosed device. It is important, therefore, that the claims be regarded as including such equivalent construction and methodology insofar as they do not depart from the spirit and scope of the present invention.

It is an object of the present invention to provide a highly adjustable, safe, and comfortable exercise machine for exercising the gluteus maximus muscles of a user.

It is another object of the present invention to provide such an exercise device which is employable by a user without the need for a spotter while using the device.

Yet another object of the invention is the provision of a resistance machine configured to require proper feet and lower leg positioning, during each use, to maximize exercise to a focused muscle group.

It is a further object of the invention to provide an exercise device which isolates the exercise performed by the user to target the gluteus maximus muscles in exercise motion directed along a sagittal plane, thereby enhancing their workout.

These and other objects, features, and advantages of the present invention, as well as the advantages thereof over existing prior art, which will become apparent from the description to follow, are accomplished by the improvements described in this specification and hereinafter described in the following detailed description which fully discloses the invention, but should not be considered as placing limitations thereon.

BRIEF DESCRIPTION OF DRAWING FIGURES

The accompanying drawings, which are incorporated herein and form a part of the specification, illustrate some, but not the only or exclusive examples of embodiments and/or features of the disclosed device. It is intended that the embodiments and figures disclosed herein are to be considered illustrative of the invention herein, rather than limiting in any fashion.

In the drawings:

FIG. 1 depicts a side view of the device having a user positioned in an as-used or an exercise position, applicable to all modes of the device, with feet positioned on a support and knees adjacent to, or contacting, a vertical support at a point across from a contact point with their buttocks or back, and with their abdomen adjacent a contact member, and showing the sagittal plane of movement which occurs during use.

DETAILED DESCRIPTION OF THE INVENTION

Figure 1:
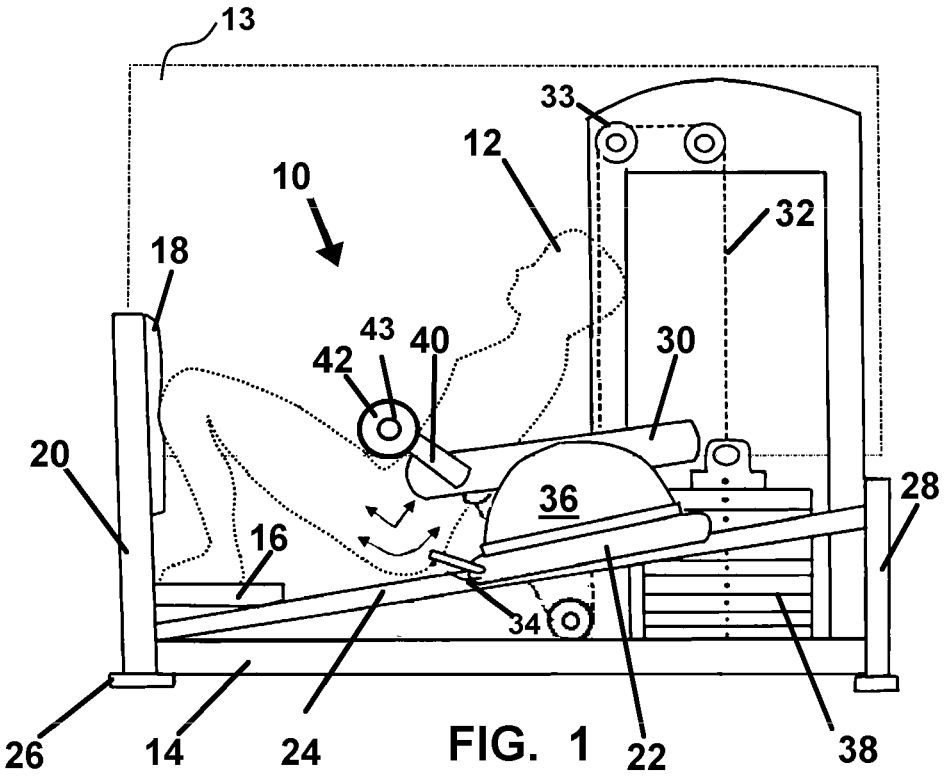

Now referring to drawings in FIGS. 1-8, wherein similar components are identified by like reference numerals, there is seen in FIG. 1, the device 10 having a user 12 situated therein in an exercise position. In all modes of the device 10 it is particularly preferred to provide a means to maintain the feet and knees supported in a substantially stationary position and properly spaced from the point on a user's mid section across from a support point for their back when in an elevated position as in FIG. 2.

Figure 2:
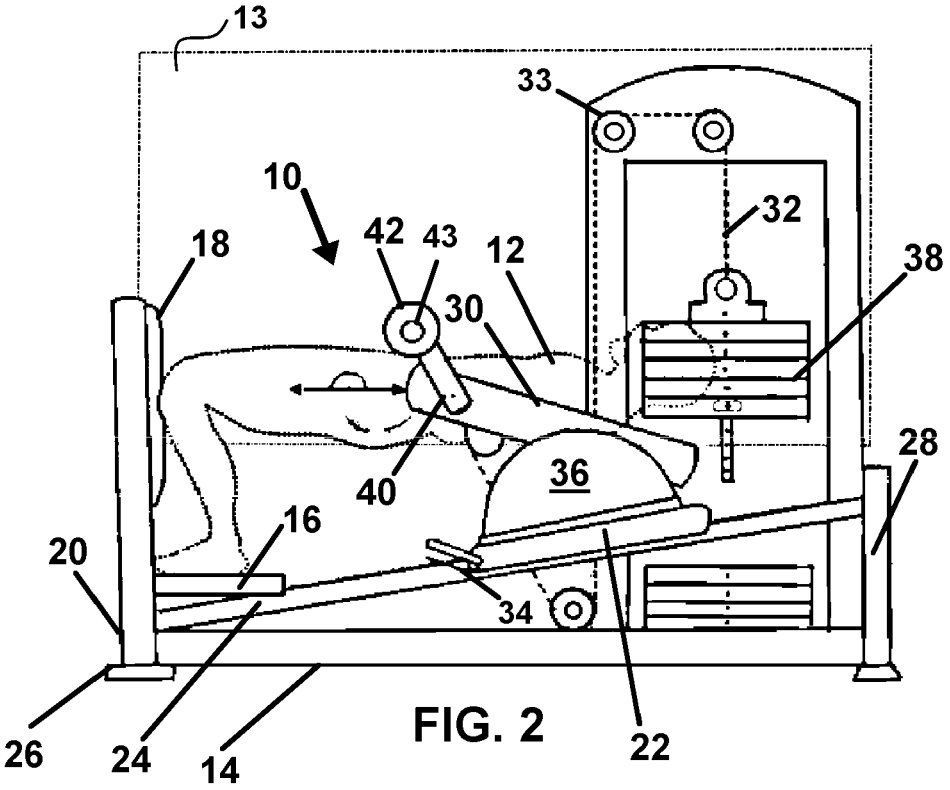
FIG. 2 shows device of FIG. 1 with the user exercising by moving to a raised or elevated position after movement along the sagittal plane, which is accomplished by raising their hips from a position supported on a back support to the elevated position, and ready for the hip flexion portion of use, with the force required for such movement isolated to the gluteus maximus muscles.

In an as-used or exercise position of FIGS. 1-2, the user is fixed on the device 10 such that upward and downward movement follows the sagittal plane 13 and the user must employ the gluteus maximus muscles to raise the member 43 which is connected with a load or resistive force. It is this fixing of the feet with angled upper legs and angled torso inclining toward the head, which helps maintain movement in line with the sagittal plane 13 and focuses the majority of exertion and exercise by the user to the gluteus maximus muscles when raising the contact member 43 which is under a load from resistance.

As can be seen in the mode of the device 10 of FIG. 1, the device 10 as shown has a frame 14 supporting the overlying engaged components on an underlying support surface. Positioned at a first end of the frame 14 is positioned a horizontally disposed foot platform 16 which supports the feet of a user, while in the exercise position on the device 10 as shown in FIGS. 1 and 2.

Adjacent the platform 16, in some preferred modes of the device 10 is preferably positioned a vertical support member 20 which may have a cushion 18. The support member 20 is preferably engaged to the first end of the frame 14. The adjacent positioning of the support member 20 and attached cushion 18, to the foot platform 16, is done to position the feet and knees such that when the user places their feet on the foot platform 16 while in the exercise position, the knees contact against the support member 20 or cushion 18 preventing lateral translation of the body of the user in the direction toward the first end of the frame 14.

It is this exercise position shown in FIG. 1 and movement to the elevated position shown in FIG. 2, along the sagittal plane 13, which runs through the middle of the body of the user during the exercise, which focuses the exercise to overcome the load from a resistive force, to the gluteus maximus muscles. It is this focusing of movement along the sagittal plane 13 during the raising to the elevated position and lowering of the body of the user to the exercise position, which helps communicate the majority of work against the load on the device 10 to the gluteus maximus muscles.

This lower leg positioning and stability portion of the device 10 forms a stop which prevents the upper leg and torso of the user from translating toward the support member 20, during use of the device 10. Combined with the positioning of the upper back of the user upon an adjustable base 22 in the exercise position, and the positioning of the back at a position across from the knee support during the elevated position, the user's waist or hips form a pivot between the torso angling upward toward the head of the user from the hips supported on a back support 36, and the upper legs angling upward from the hips toward the knees, which are elevated above the foot support. This positioning of the hips of the user in the exercise position, with the upper legs and torso of the user both angling upward at opposite angles, isolates the gluteus maximus muscles during use for targeted exercise when the user moves to the raised position of FIG. 2, and raises their hips a distance off the back support in a direction toward a position where the upper legs and torso may align. The user need not align the upper legs and torso but will move toward doing so when moving to the elevated position.

To allow the user to move the back support 36 to a proper and comfortable exercise position if desirable, a translatable base 22 supporting the back support 36, may be slidably engaged with one or a plurality of diagonal tracks 24 which incline from a lower end adjacent the foot platform 16, toward a higher end engaged to a riser 28 adjacent the second end of the frame 14 opposite the first end.

A currently preferred mode of the device 10 positions the diagonal track 24 at an angle between 5 and 20 degrees on an incline from the plane, with 10 degrees being particularly preferred as an angle employable for use with most users 12.

The base 22 is slidable by users 12 to position it at different elevations along the track 24 to support their torso during use. Such adjustment of the base 22 allows for position adjustment of the back of the user to one that is comfortable and in a raised position across from the support of the knees. As noted, positioning of the hips against this back support 36, and fixed positioning of the feet and knees in the exercise position, isolate the communication of the load from resistance from the engaged cable 32, to the pivoting arm 30, to work the gluteus maximus muscles as the user pivots the body from the exercise position of FIG. 1, to the elevated position such as in FIG. 2.

In all modes of the device, the base 22 may be in a ratcheted engagement with a track 24, or the device may employed other means to prevent it from sliding downward on the track 24 during adjustment. If employed, a ratchet may be released using a release handle 34 for users wishing to move the base 22 downward toward the foot rest 16 to change where the back is supported.

The back support 36 should be comfortable and can be formed of a cushioning material such as with dense foam material, and when engaged to the base 22 provides a padded contact with the backside of the user 12 when in the as-used or exercise position. The pivot point of the pivoting arm 30, may be fixed in positioning whereby the user will move the back support 36 only during positioning, or it may be made adjustable to move it toward or away from the foot pad 16 end of the device, or to adjust the mechanical advantage communicated to the cable 32 during use.

The pivoting arm 30 in all modes of the device, is in operative engagement with a load or resistive force providing the load resisting the elevation of the pivoting arm 30 by the user. In one mode a cable 32 or member can be engaged at the other end with the pivoting arm 30, and at the other with fixed or preferably variable load or resistance, such as a weight stack 38, or other resistive device such as a pneumatic cylinder, hydraulic cylinder, elastic band, spring or the like. In another mode of the device 10 such as in FIG. 8, free weights 48 can be engaged to the pivoting arm 30, such as on a weight support member 49 similar to a barbell engaged to the pivoting arm 30.

As shown in all modes of the device 10 in FIGS. 1-8, a secondary arm 40 is engaged with the pivoting arm 30 at one end and with a cushioned 42 or uncushioned contact member 43 at or adjacent the opposite end. While pictured as static in length, this secondary arm 40 may be telescopic to adjust length or to provide a plurality of sizes or adjustable sizes in length. Adjusting the length would allow a means for varied positioning of a cushioned or uncushioned contact member 43 engaged at a distal end of the secondary arm 40.

In all modes of the device 10 herein, with the user 12 in the exercise position such as in FIGS. 1-2, with their back contacting the back support 36 positioned on the base 22, and their feet upon the foot platform 16 and their knees adjacent or contacting a vertical support 20 or if provided, a vertical cushion 18, the user will employ the device 10 and rotate the pivoting arm 30 from a lowered or almost sitting position of FIG. 1, where the axis of their spine is substantially perpendicular or normal to the axis of their femur, to a raised position of FIG. 2, and back again. The positioning of the user on the foot support and back support and positioning of the contact member against the body, focuses the movement of the user along the sagittal plane. This is key to the device, as is the fixed positioning of the feet and knees and the support of the back with the back support 36, which positions the hip joints of the user as the pivot as the body bends. This results in a communication of the major amount of load or resistance to movement to the gluteus maximus muscles during their employment to pivot the waist and raise the contact member 43 and pivoting arm 30.

Figure 3:
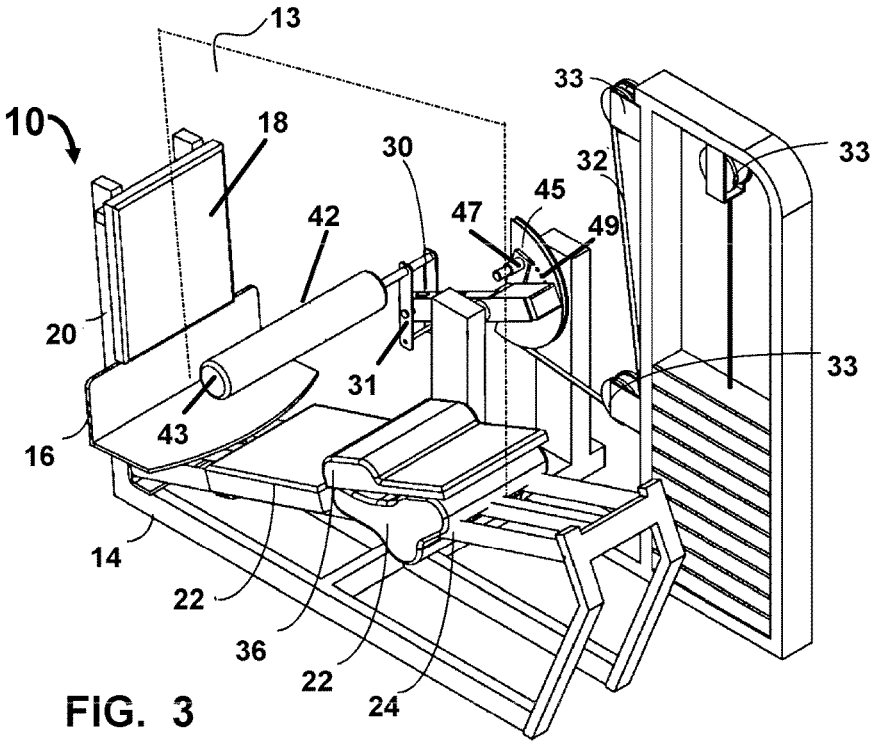
FIG. 3 shows another mode of the device similar to FIG. 1, illustrating a bottom view of the device showing the sagittal plane of motion the device directs user movement along by maintaining positioning of the feet, knees, and head.
Figure 4:
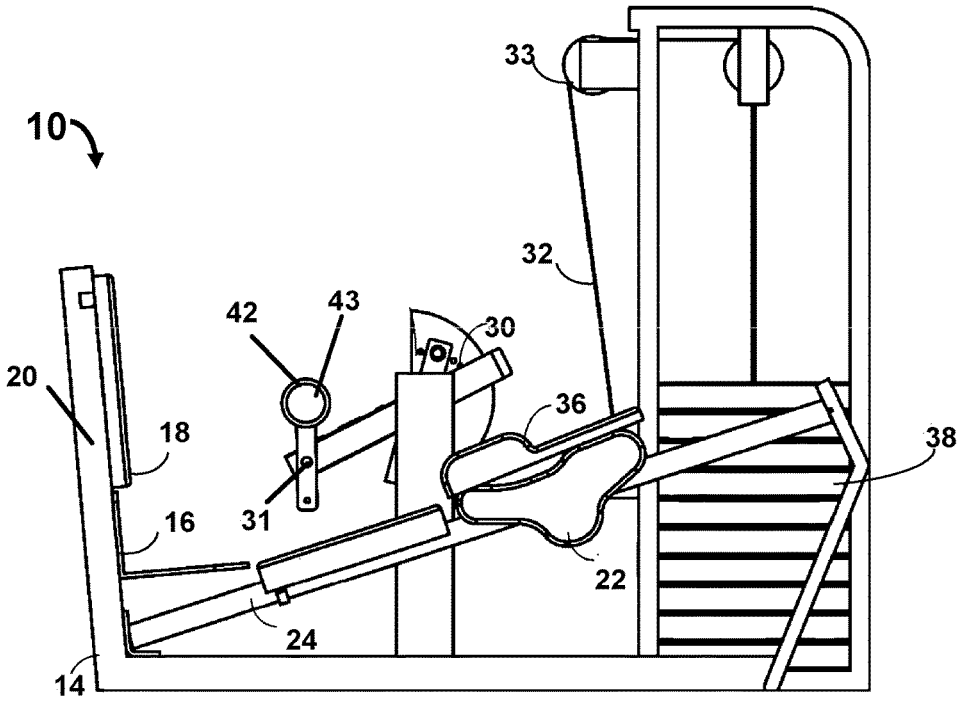
FIG. 4 depicts a side view of the mode of the device as in FIG. 3.

Depicted in FIG. 3-4 is another mode of the device 10 similar to FIG. 1 and configured to isolate the gluteus maximus muscles during use. Shown are the foot platform 16 adjacent the support member having the cushion 18 for contact with the knees of the user in the exercise position. A back support 36 may be positioned atop the slidable base 22 as in other modes or the back support 36 may be the slidable base 22. The contact member 43 is positioned to contact the abdomen of the user during use. Also shown are a flexible member or cable 32 connecting the pivoting arm 30 to the adjustable weight stack, or other means to generate a load or resistance. Changes in direction of the cable 32 are provided by one or a plurality of pulleys 33 positioned on the device 10.

The contact arm 43 may be in a fixed engagement with the pivoting arm 30, however during experimentation with the device 10 it was unexpectedly found that a rotating or pivoting engagement 31 of the contact arm 43 to the pivoting arm 30, provided a self-centering action during use. Essentially, the contact arm 43, if allowed to move on the pivoting engagement, will self center on the user's waist or abdomen at a comfortable position and usually at the pivot point on the user such as shown in FIG. 1. Thus, while a fixed engagement of the contact arm 43 to the pivoting arm 30 works well during use to help maintain the body of the user along the sagittal plane, the pivoting engagement 31 is more preferred.

Figure 5:
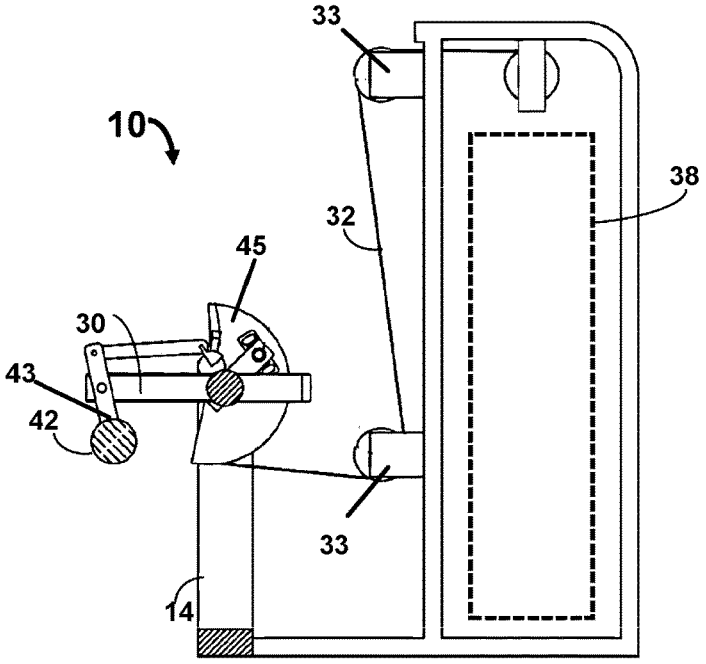
FIG. 5 shows the load or resistive force system of the device using a weight stack connected to cable which is connected or in communication with the second arm and a padded or unpadded member.

Shown in FIG. 5, is the load from the resistive force components of the device 10, which employ the cable 32 and pulleys 33 to connect to a weight stack 38 shown in dotted line to indicate other load generating means for resistance may be employed. As can be seen, force imparted against the contact member 43 will cause the pivoting arm 30 to rotate and move the cable 33 which is resisted by load from the weight stack 38 or other means of resistance to movement of the pivoting arm 30 such as hydraulic, pneumatic, frictional, or elastic resistance. An adjustable cam 45 for changing the contact member 43 position relative to the abdomen of the user is also shown. Changing a pin 47 to engagement with a line of sequential holes 40 adjusts an angular position of the cam 45 in its rotational engagement with the frame, to thereby rotate the pivoting arm 30 and adjust contact member to positions closer or further from the back support. In this mode the cam 45 engages with the load resisting rotation.

Figure 6:
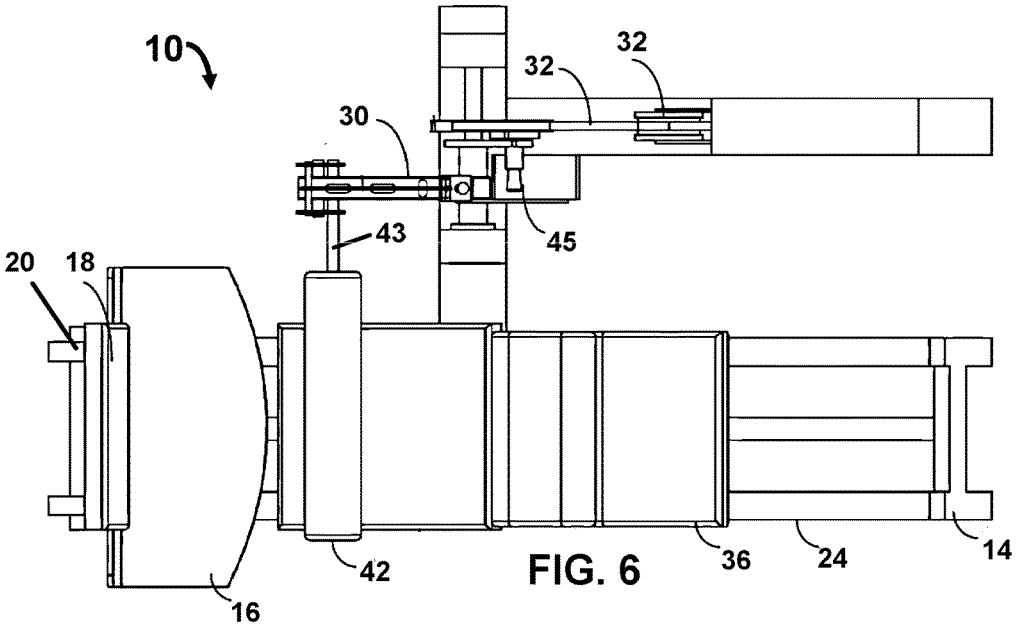
FIG. 6 shows an overhead view of a the device of FIG. 3.
Figure 7:
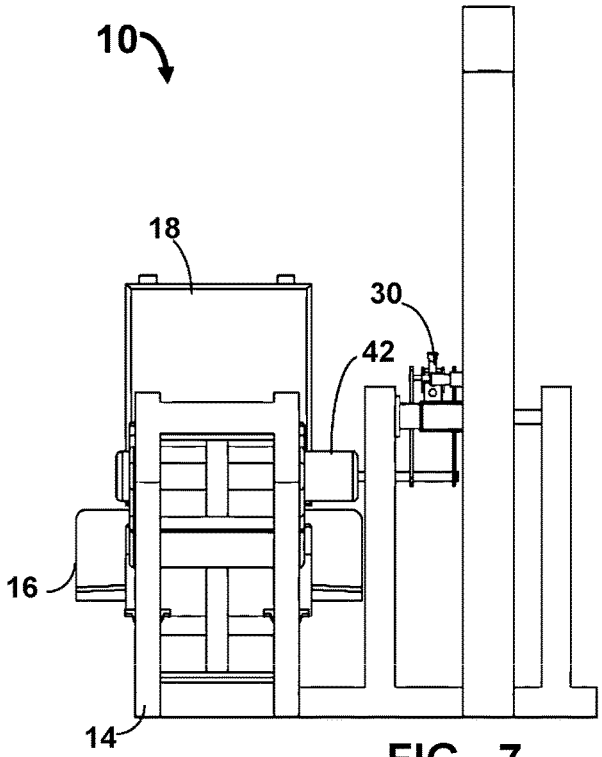
FIG. 7 shows an end view of the device of FIG. 6.

Shown in FIG. 6 is an overhead view of the device such as in FIG. 3. Depicted are the foot platform 16 adjacent the pad 18 on the support member 20. Also shown is the contact member 43 engaged with the pivoting arm 30 which will communicate force to the cable 32 to overcome the load generated by the resistive force attached. The same components may be viewed in the device as shown in FIG. 7.

Figure 8:
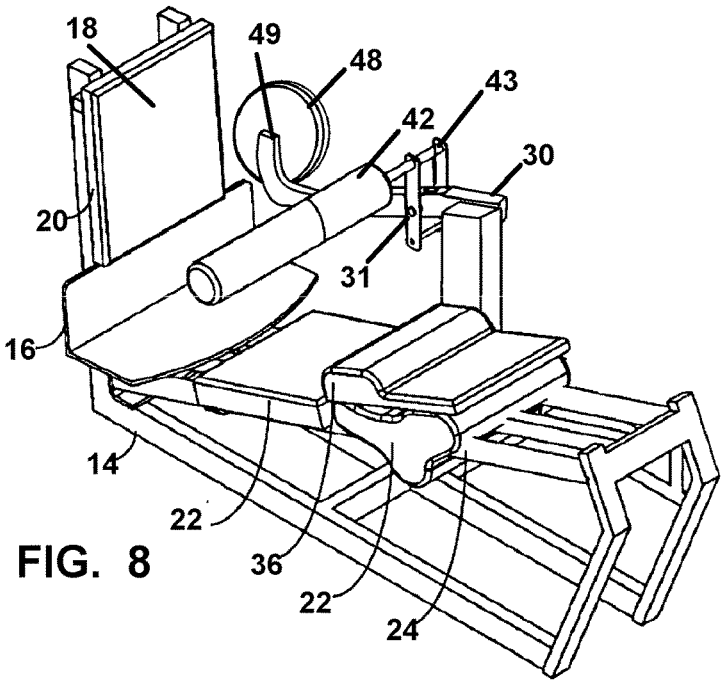
FIG. 8 depicts a mode of the device employing free weights for resistance to rotation of the pivoting arm.

Finally, depicted in FIG. 8, is a mode of the device 10 adapted to employ free weights 48 as the load or resistive force to the rotation of the pivoting arm 30 when moved by the user contacting the contact member 43. This mode of the device 10, as can be seen, includes the foot and knee engagements and back support noted above as providing the means to isolate and target the gluteus maximus muscles during exercise. The free weights 48 are shown operatively engaged to the pivoting arm 30.

As noted, any of the different configurations and components of the exercise device 10 can be employed with any other configuration or component shown and described herein.

Additionally, while the present invention has been described herein with reference to particular embodiments thereof and steps in the method of production, a latitude of modifications, various changes and substitutions are intended in the foregoing disclosures, it will be appreciated that in some instance some features, or configurations, or steps in formation of the invention could be employed without a corresponding use of other features without departing from the scope of the invention as set forth in the following claims. All such changes, alternations and modifications as would occur to those skilled in the art are considered to be within the scope of this invention as broadly defined in the appended claims.

Further, the purpose of any abstract of this specification is to enable the U.S. Patent and Trademark Office, the public generally, and especially the scientists, engineers, and practitioners in the art who are not familiar with patent or legal terms or phraseology, to determine quickly from a cursory inspection the nature and essence of the technical disclosure of the application. Any such abstract is neither intended to define the invention of the application, which is measured by the claims, nor is it intended to be limiting, as to the scope of the invention in any way.

What is claimed is:

1. An exercise machine, comprising:

a frame having a first end and a second end opposite said first end;

a foot support positioned at said first end of said frame;

a back support engaged with said frame, said back support inclining from a lower first end closest to said first end of said frame, to a higher end closest to said second end of said frame;

said exercise machine defining an exercise position for said user, requiring positioning both feet of said user upon said foot support thereby positioning upper legs of said user inclining along a line running from their hips supported upon said back support, toward their knees, and positioning a torso of said user inclining in a direction running from said hips toward their head elevated above said hips;

a pivoting arm rotationally engaged with said frame;

a contact member in a connection at one end to said pivoting arm, said contact member extending from said pivoting arm in a horizontal disposition above said back support to a distal end;

said contact member rotating said pivoting arm when moved from a lowered position closest to said back support, to a raised position;

said pivoting arm configured for engagement with a load which resists movement of said contact member from said lowered position to said raised position; and whereby a user positioned in said exercise position, and having a portion of their abdomen between said knees and their shoulders contacting said contact member, may only move said contact member from said lowered position toward said raised position, by a movement of said body of said user along a sagittal plane, from said exercise position, to an elevated position, by employing the gluteus maximus muscles to overcome said load and elevate said hips of said user above said back support.

2. The exercise machine of claim 1, further comprising:

a vertical support member positioned at said first end of said frame, adjacent said foot support; and said vertical support positioned for a contact with said knees of said user during movement of said body from said exercise position to said elevated position; and a said contact of said knees with said vertical support forming a stop preventing lateral translation of said body of said user toward said first end of said frame, during movement between said exercise position and said elevated position.

3. The exercise machine of claim 1, further comprising:

a pivoting arm rotationally engaged with said frame; and said connection of said contact member with said pivoting arm being a rotational connection allowing a pivoting of said contact member.

4. The exercise machine of claim 2, further comprising:

a pivoting arm rotationally engaged with said frame; and said connection of said contact member with said pivoting arm being a rotational connection allowing a pivoting of said contact member.

5. The exercise machine of claim 1 wherein said back support is in a sliding engagement with said frame, whereby said back support is adjustable to a plurality of positions upon said frame between said foot support and said second end of said frame.

6. The exercise machine of claim 2 wherein said back support is in a sliding engagement with said frame whereby said back support is adjustable to a plurality of positions upon said frame between said foot support and said second end of said frame.

7. The exercise machine of claim 3 wherein said back support is in a sliding engagement with said frame whereby said back support is adjustable to a plurality of positions upon said frame between said foot support and said second end of said frame.

8. The exercise machine of claim 4 wherein said back support is in a sliding engagement with said frame whereby said back support is adjustable to a plurality of positions upon said frame between said foot support and said second end of said frame.

9. The exercise machine of claim 1 further comprising:

said pivoting arm engaged with a cam which is in a rotational engagement with said frame;

said cam being adjustable in an angular position around said rotational engagement by engagement of a pin with one of a plurality of holes in said cam; and adjustment of said angular position of said cam concurrently adjusting a distance of said contact member from said back support.

10. The exercise machine of claim 2 further comprising:

said pivoting arm engaged with a cam which is in a rotational engagement with said frame;

said cam being adjustable in an angular position around said rotational engagement by engagement of a pin with one of a plurality of holes in said cam; and adjustment of said angular position of said cam concurrently adjusting a distance of said contact member from said back support.

11. The exercise machine of claim 3 further comprising:

said pivoting arm engaged with a cam which is in a rotational engagement with said frame;

said cam being adjustable in an angular position around said rotational engagement by engagement of a pin with one of a plurality of holes in said cam; and adjustment of said angular position of said cam concurrently adjusting a distance of said contact member from said back support.

12. The exercise machine of claim 4 further comprising:

said pivoting arm engaged with a cam which is in a rotational engagement with said frame;

said cam being adjustable in an angular position around said rotational engagement by engagement of a pin with one of a plurality of holes in said cam; and adjustment of said angular position of said cam concurrently adjusting a distance of said contact member from said back support.

13. The exercise machine of claim 5 further comprising:

said pivoting arm engaged with a cam which is in a rotational engagement with said frame;

said cam being adjustable in an angular position around said rotational engagement by engagement of a pin with one of a plurality of holes in said cam; and adjustment of said angular position of said cam concurrently adjusting a distance of said contact member from said back support.

14. The exercise machine of claim 6 further comprising:

said pivoting arm engaged with a cam which is in a rotational engagement with said frame;

said cam being adjustable in an angular position around said rotational engagement by engagement of a pin with one of a plurality of holes in said cam; and adjustment of said angular position of said cam concurrently adjusting a distance of said contact member from said back support.

15. The exercise machine of claim 7 further comprising:

said pivoting arm engaged with a cam which is in a rotational engagement with said frame;

said cam being adjustable in an angular position around said rotational engagement by engagement of a pin with one of a plurality of holes in said cam; and adjustment of said angular position of said cam concurrently adjusting a distance of said contact member from said back support.

16. The exercise machine of claim 8 further comprising:

said pivoting arm engaged with a cam which is in a rotational engagement with said frame;

said cam being adjustable in an angular position around said rotational engagement by engagement of a pin with one of a plurality of holes in said cam; and adjustment of said angular position of said cam concurrently adjusting a distance of said contact member from said back support.

17. The exercise machine of claim 1 wherein said load which resists movement is generated by one or a combination of load generators from a group of load generators including a weight stack, a free weight, elastic members, springs, hydraulic resistance components and pneumatic resistance components.

18. The exercise machine of claim 10 wherein said load which resists movement is generated by one or a combination of load generators from a group of load generators including a weight stack, a free weight, elastic members, springs, hydraulic resistance components and pneumatic resistance components.

19. The exercise machine of claim 15 wherein said load which resists movement is generated by one or a combination of load generators from a group including a weight stack, a free weight, elastic members, springs, hydraulic resistance components and pneumatic resistance components.

20. The exercise machine of claim 2 wherein said back support inclines from said lower first end toward said higher end, at an angle between 5 degrees to 20 degrees.

* * * * *